US007533705B1

(12) United States Patent
Manring

(10) Patent No.: US 7,533,705 B1
(45) Date of Patent: May 19, 2009

(54) CUTTING APPARATUS

(76) Inventor: James E. Manring, 13284 Justin Rd., Utica, OH (US) 43080

( * ) Notice: Subject to any disclaimer, the term of this patent is extended or adjusted under 35 U.S.C. 154(b) by 122 days.

(21) Appl. No.: 11/671,989

(22) Filed: Feb. 6, 2007

(51) Int. Cl.
*B25H 1/00* (2006.01)
*B26D 7/01* (2006.01)

(52) U.S. Cl. ..... 144/286.5; 144/287; 3/468.3; 3/471.3

(58) Field of Classification Search ..... 144/144.1, 144/144.52, 286.1, 286.5, 287; 83/574, 468.1–468.7, 83/471.3, 473, 490
See application file for complete search history.

(56) References Cited

U.S. PATENT DOCUMENTS 4,341,247 A * 7/1982 Price ..... 144/287
4,798,113 A * 1/1989 Viazanko ..... 83/471.3
5,526,856 A * 6/1996 Pedri ..... 144/287
RE35,627 E * 10/1997 Estrem ..... 144/329
6,116,304 A * 9/2000 Wilson et al. ..... 144/154.5
6,206,060 B1 * 3/2001 Blake ..... 144/87
6,581,656 B1 * 6/2003 Harper ..... 144/287
6,991,009 B1 * 1/2006 Wedeward ..... 144/144.1
2006/0086418 A1 * 4/2006 Williams ..... 144/144.1
2007/0039441 A1 * 2/2007 Lacy ..... 83/473

* cited by examiner

*Primary Examiner*—Shelley Self
(74) *Attorney, Agent, or Firm*—Ronald J. Koch

(57) ABSTRACT

An improved cutting apparatus replaces the extension arm of a conventional compound miter saw and has a base member 100, a saw interface 110, brace assembly 200, base member slide assembly 300, and leg assembly 400.

6 Claims, 6 Drawing Sheets

CUTTING APPARATUS

BACKGROUND AND SUMMARY

The present invention relates to cutting apparatus and more specifically to utilizing miter saws to cut wood or other materials.

Miter saws are well known as are compound miter saws. A compound miter saw generally comes with an extension arm. The purpose thereof is to assist in the positioning of the object to be cut. These saws are particularly useful in cutting wood at a specific angle. However, there are some disadvantages inherent in these systems.

Although the miter saws allow placement of the blade at a specific angle thus allowing multiple cuts at the exact angle, there does not exist a way to allow a specific angle and a specific length to be cut. Conventional methods comprise placing a board on the extension rail and relying on a tape measure or other measuring device to insure that the pieces are cut to the desired length.

The present invention overcomes these limitations. It allows for precise, repetitious cutting at exact angles and lengths. A guide, having an adjustable face (relative to the saw blade) is movable along a base member. The base member replaces the extension rail of the saw. The guide is set at a desired angle and location to allow for precise cutting at the same angle and length.

The invention is particularly useful in cutting picture and small cabinet door frames. A first cut is made in one end of one of the frame members, independent of the guide. Then, the board is flipped upside down and the newly cut edge is placed against the guide so as to be parallel with it. The guide is then moved longitudinally along the base member so as to direct where the second cut is made. A second cut is made on the opposite end of the board. Thus, the first member of the picture frame is cut.

This process is repeated to cut the opposite member of the picture frame except that the guide is not moved. This insures that the second board is of identical length. A primary advantage of the present invention is thereby achieved because the second board is cut to the exact dimensions of the first board.

If the frame is square, the above procedure is repeated without moving any parts of the invention. Alternatively, if the frame is rectangular, the guide must be repositioned before cutting the third and fourth frame members. Otherwise, the process is the same.

REFERENCE NUMERALS IN DRAWINGS

Figure 1:
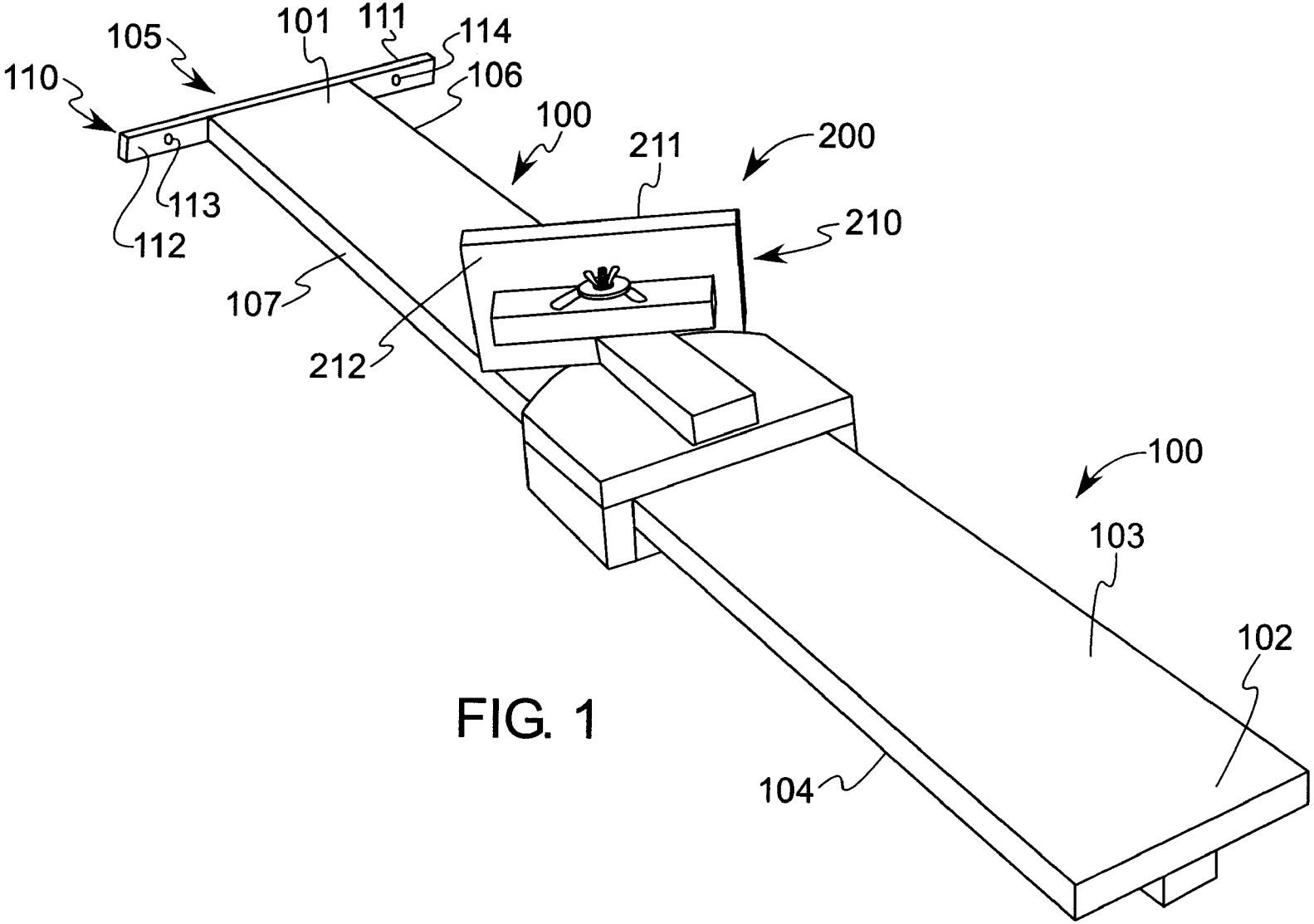
FIG. 1 depicts a perspective view of a preferred embodiment of the present invention.
Figure 2:
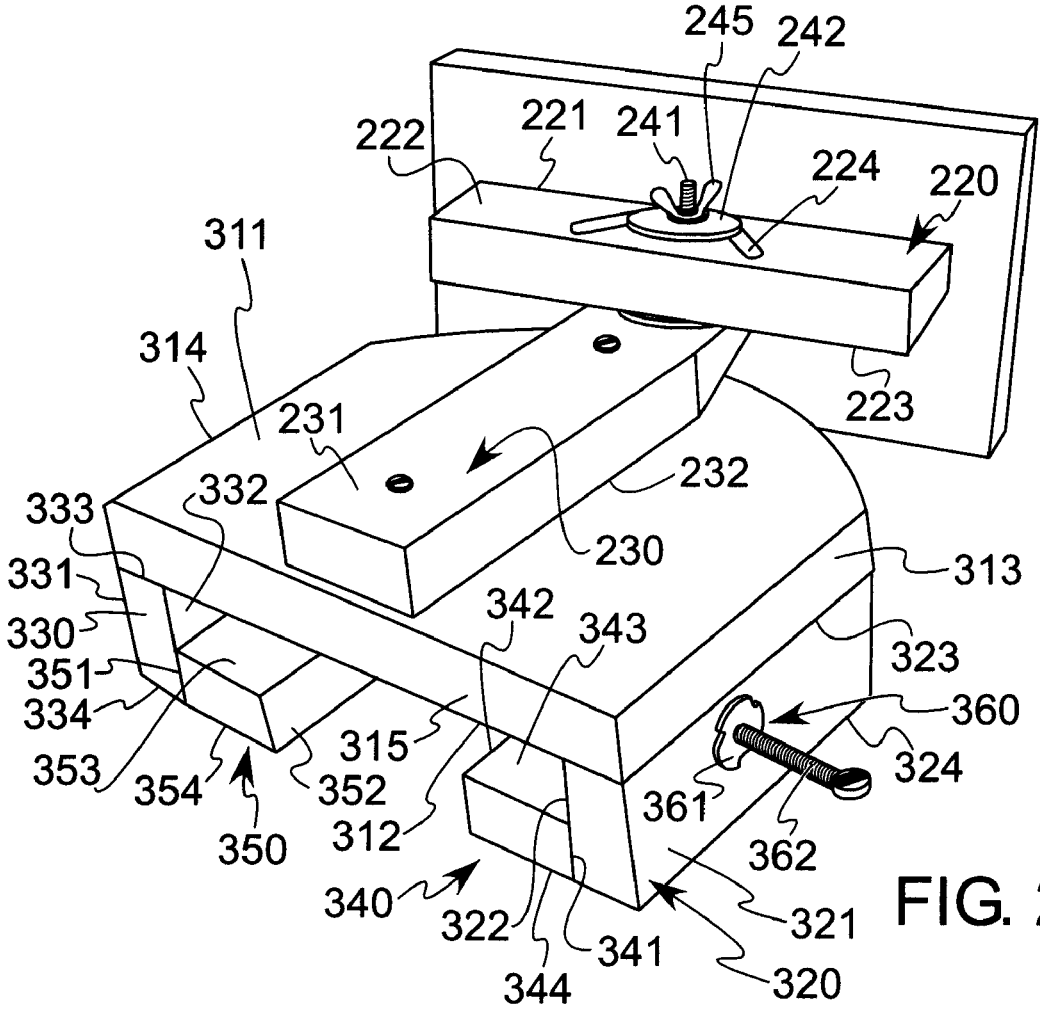
FIG. 2 depicts a perspective view of brace assembly 200 and base member slide assembly 300.
Figure 3:
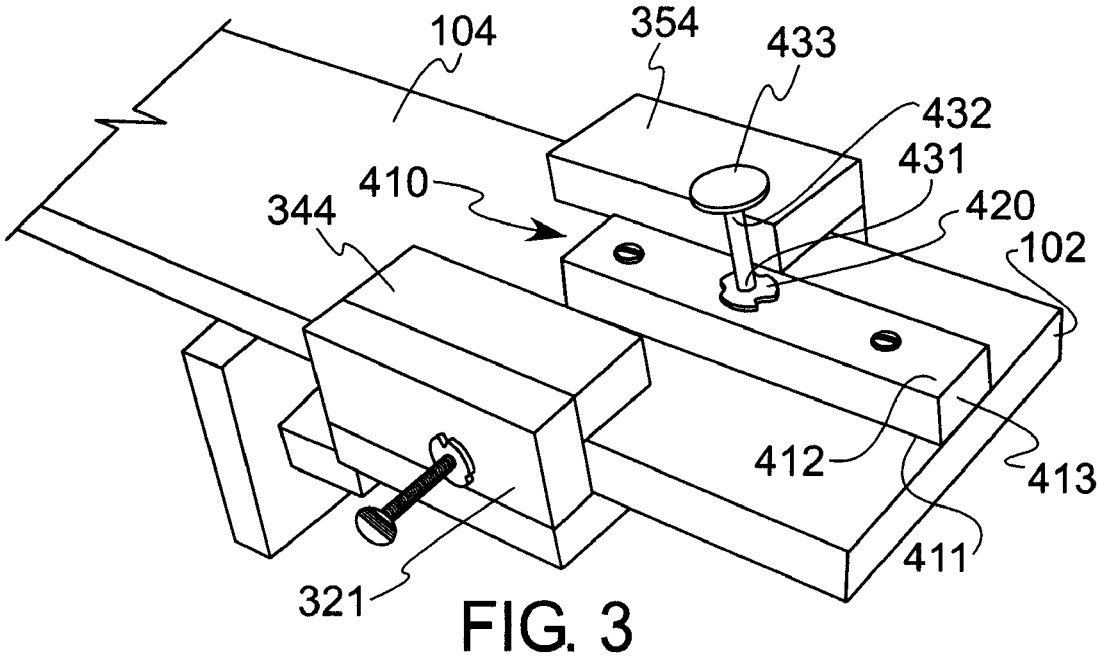
FIG. 3 depicts a perspective view of leg assembly 400 and base member slide assembly 300.
Figure 4:
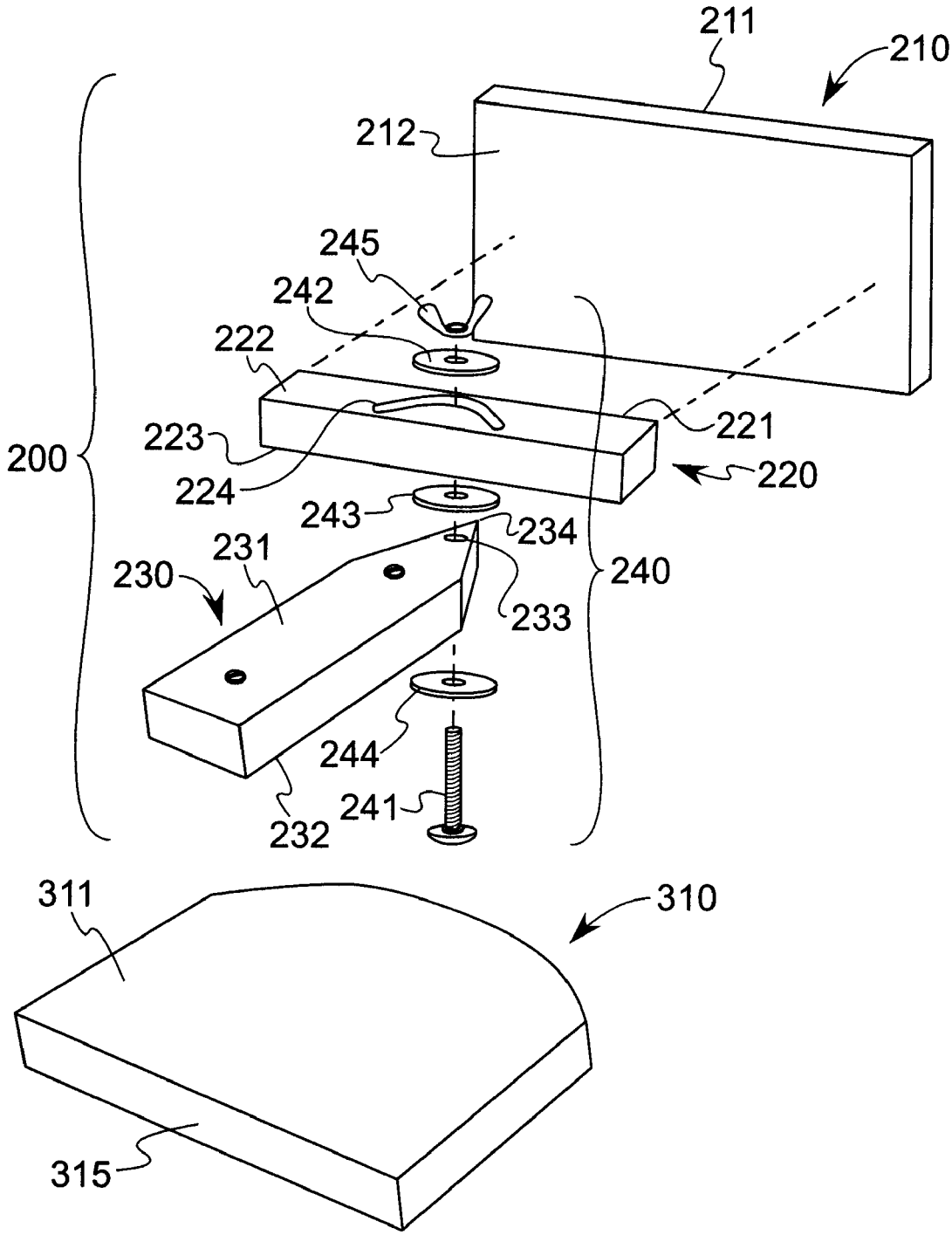
FIG. 4 depicts an exploded view of brace assembly 200 and angle lock 240.
Figure 5:
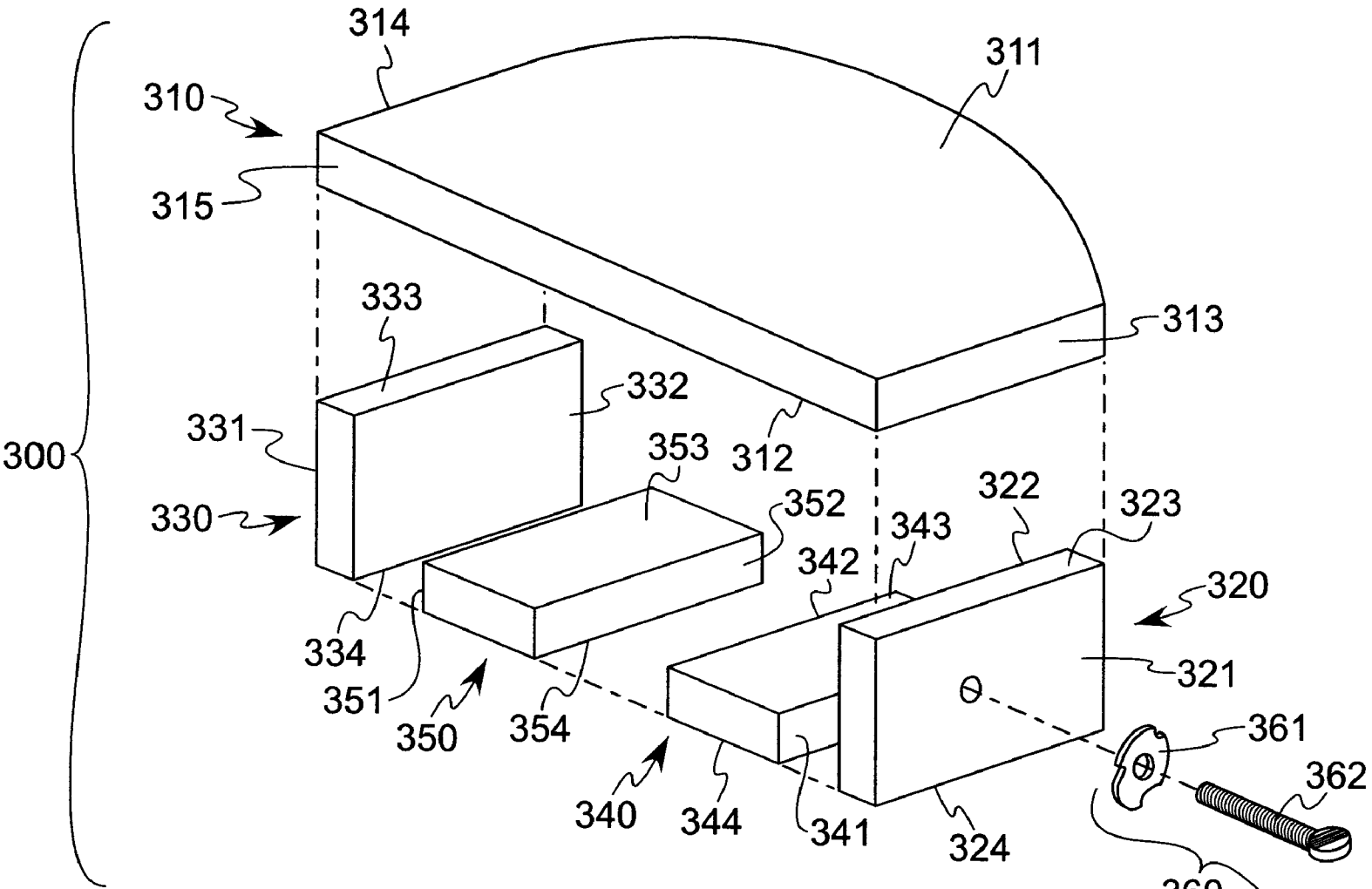
FIG. 5 depicts an exploded view of base member slide assembly 300.

The table below lists the reference numerals employed in the figures, and identifies the element designated by each numeral.

100 base member 100
101 first end 101 of base member
102 second end 102 of base member
103 base member upper surface 103
104 base member lower surface 104
105 face 105 of first end of base member
106 first side 106 of base member
107 second side 107 of base member
110 saw interface 110
111 saw interface outer surface 111
112 saw interface inner surface 112
113 first aperture 113 of saw interface
114 second aperture 114 of saw interface
200 brace assembly 200
210 guide 210
211 guide outer surface 211
212 guide inner surface 212
220 guide support 220
221 first side 221 of guide support
222 upper surface 222 of guide support
223 lower surface 223 of guide support
224 aperture 224 of guide support
230 top cross member 230
231 top cross member upper surface 231
232 top cross member lower surface 232
233 aperture 233 of top cross member
234 first end 234 of top cross member
240 angle lock 240
241 machine screw 241
242 upper washer 242
243 middle washer 243
244 lower washer 244
245 wing nut 245
300 base member slide assembly 300
310 top board 310
311 top board upper surface 311
312 top board lower surface 312
313 first side 313 of top board
314 second side 314 of top board
315 third side 315 of top board
320 first side board 320
321 first side board outer surface 321
322 first side board inner surface 322
323 first side board upper surface 323
324 first side board lower surface 324
330 second side board 330
331 second side board outer surface 331
332 second side board inner surface 332
333 second side board upper surface 333
334 second side board lower surface 334
340 first lower board 340
341 first lower board outer surface 341
342 first lower board inner surface 342
343 first lower board upper surface 343
344 first lower board lower surface 344
350 second lower board 350
351 second lower board outer surface 351
352 second lower board inner surface 352
353 second lower board upper surface 353

354 second lower board lower surface 354
360 lock assembly 360
361 lock assembly connector 361
362 lock assembly thumb screw 362
400 leg assembly 400
410 bottom cross member 410
411 bottom cross member upper surface 411
412 bottom cross member lower surface 412
413 first end of bottom cross member 413
420 leg connector 420
430 leg 430
431 leg first end 431
432 second end 432 of leg
433 leg base 433
100A base member 100A of an alternate preferred embodiment
101A first end 101A of base member of an alternate preferred embodiment
102A second end 102A of base member of an alternate preferred embodiment
103A base member upper surface 103A of an alternate preferred embodiment
104A base member lower surface 104A of an alternate preferred embodiment
105A face 105A of first end of base member of an alternate preferred embodiment
106A first side 106A of base member of an alternate preferred embodiment
107A second side 107A of base member of an alternate preferred embodiment
110A saw interface 110A of an alternate preferred embodiment
111A saw interface outer surface 111A of an alternate preferred embodiment
112A saw interface inner surface 112A of an alternate preferred embodiment
113A first aperture 113A of saw interface of an alternate preferred embodiment
114A second aperture 114A of saw interface of an alternate preferred embodiment
210A guide 210A of an alternate preferred embodiment
211A guide outer surface 211A of an alternate preferred embodiment
212A guide inner surface 212A of an alternate preferred embodiment
241A machine screw 241A of an alternate preferred embodiment
242A upper washer 242A of an alternate preferred embodiment
244A lower washer 244A of an alternate preferred embodiment
245A wing nut 245A of an alternate preferred embodiment
400A leg assembly 400A of an alternate preferred embodiment
410A bottom cross member 410A of an alternate preferred embodiment
411A bottom cross member upper surface 411A of an alternate preferred embodiment
412A bottom cross member lower surface 412A of an alternate preferred embodiment
413A first end of bottom cross member 413A of an alternate preferred embodiment
420A leg connector 420A of an alternate preferred embodiment
430A leg 430A of an alternate preferred embodiment
431A leg first end 431A of an alternate preferred embodiment
432A second end 432A of leg of an alternate preferred embodiment
433A leg base 433A of an alternate preferred embodiment
500A slot 500A of an alternate preferred embodiment

DETAILED DESCRIPTION

One preferred embodiment (FIGS. 1-5) of an improved cutting apparatus comprises a base member 100, a saw interface 110, brace assembly 200, base member slide assembly 300, and leg assembly 400. The cutting apparatus is preferably made of aluminum or light metal alloy, but can be made of other materials (wood, plastic, etc.) Provided their strength and rigidity is comparable.

The base member 100 is elongated and rigid with rectangular cross section. It is substantially 5.25 inches in width by 47.9 inches in length by 0.8 inches in height. It has a first end 101, a first side 106, a second side 107, a face 105 of first end, a second end 102, a lower surface 104, and an upper surface 103. The saw interface 110 is substantially planar, has a first aperture 113, a second aperture 114, an inner surface 112, and an outer surface 111. The inner surface 112 of the saw interface 110 is fixedly secured to the face 105 of the first end 101 of the base member 100.

The saw interface 110 is adapted to connect to a conventional compound miter saw such that the cutting apparatus replaces the extension rail of the saw. As will be appreciated, the purpose of the saw interface is to allow the invention to connect to standard compound miter saws in replacement of the extension rails. Accordingly, the distance between the apertures may be changed as needed to achieve this end.

Leg assembly 400 comprises: bottom cross member 410, leg connector 420, leg 430, and leg base 433. The bottom cross member 410 has an upper surface 411, a lower surface 412, and a first end 413. It is elongated, rigid, and has rectangular cross-section. The upper surface 411 of the bottom cross member 410 is fixedly secured to the lower surface 104 of the base member 100. The first end 413 of the bottom cross member 410 is adjacent to the second end 102 of the base member 100. The bottom cross member 410 is located approximate the lateral center of the lower surface 104 of the base member 100.

Leg 430 has a first end 431 and a second end 432. It is elongated and rigid and has adjustable length. It has a circular cross-section, a threaded outer surface and is in threaded communication with the leg connector 420.

The leg connector 420 is fixedly secured to the lower surface 412 of the bottom cross member 410. It is located approximate the lateral center of the lower surface 412 of the bottom cross member 410. The second end 432 of the leg is rotatedly secured to the leg base 433.

As will be appreciated, the purpose of the leg 430 is to adjust the base member 100 so it is substantially horizontal. It will therefore be obvious that myriad ways of adjusting this height are possible and that any method can be used so long as the purpose is achieved.

One preferred embodiment (FIGS. 1-5) comprises the leg 430 being threaded and being capable of being placed within the leg connector 420 which has a threaded recess to receive leg 430. A recess hole (not shown) is displaced within bottom cross member lower surface 412 so that leg first end 431 of leg 430 can move within the recess as leg 430 is rotated. Thus, the leg may be rotated thereby adjusting the height. Another embodiment (not shown) comprises leg 430 being a telescoping arm capable of locking in place (or being maintained by friction).

Brace assembly 200 comprises: guide 210, guide support 220, top cross member 230, and angle lock 240. The guide 210 is substantially 6.9 inches long by 3.8 inches wide. It has an outer surface 211 and an inner surface 212.

The guide support 220 has a first side 221, an upper surface 222, and a lower surface 223. It is substantially 5.5 inches in length. The first side 221 of the guide support 220 is fixedly secured to the inner surface 212 of the guide 210. The guide support 220 is located approximate the vertical center of the inner surface 212 of the guide. The guide support has an aperture 224.

The top cross member 230 has an upper surface 231, a lower surface 232, an aperture 233, and a first end 234. It is substantially 1.8 inches in width by 6 inches in length. Aperture 233 is located approximate the center of the first end 234 of the top cross member 230 and approximate the lateral center of top cross member upper surface 231.

The guide support 220 is rotationally secured to the top cross member 230 by the angle lock 240. The angle lock 240 comprises a machine screw 241, an upper washer 242, a middle washer 243, a lower washer 244, and a wing nut 245.

The machine screw 241 runs through the lower washer 244, the aperture 233 of the top cross member 230, the middle washer 243, the aperture 224 of the guide support, the upper washer 242, and the wing nut 245.

The lower washer 244 is located between the head of the machine screw 241 and the lower surface 232 of the top cross member 230. The middle washer 243 is located between the upper surface 231 of the top cross member 230 and the lower surface 223 of the guide support 220. The upper washer 242 is located between the upper surface 222 of the guide support 220 and the wing nut 245.

The wing nut 245 is in rotational engagement with the machine screw 241 above the upper surface 222 of the guide support 220. The aperture 224 of the guide support 220 is in the shape of an arc, so as to allow the guide to rotate about the base member 100 relative to top board 310. In operation, wing nut 245 is loosened and the guide 210 is moved to the desired angle. Then the wing nut is tightened thereby securing the guide.

Base member slide assembly 300 comprises: top board 310, first side board 320, second side board 330, first lower board 340, second lower board 350, and lock assembly 360.

The top board 310 is substantially 6.9 inches in width and 5.5 inches in length and 0.8 inches in height, and has an upper surface 311, a lower surface 312, a first side 313, a second side 314, and a third side 315.

The first side board 320 is substantially 4 inches long by 2.1 inches high and has an outer surface 321, an inner surface 322, an upper surface 323, and a lower surface 324.

The second side board 330 is substantially 4 inches long by 2.1 inches high and has an outer surface 331, an inner surface 332, an upper surface 333, and a lower surface 334.

The first lower board 340 is substantially 4 inches long by 2.1 inches wide and has an outer surface 341, an inner surface 342, an upper surface 343, and a lower surface 344.

The second lower board 350 is substantially 4 inches long by 2.1 inches wide and has an outer surface 351, an inner surface 352, an upper surface 353, and a lower surface 354.

The upper surface 311 of the top board 310 is fixedly secured to the lower surface 232 of the top cross member 230. The top cross member 230 is approximate the lateral center of the upper surface 311 of the top board 310.

The upper surface 323 of the first side board 320 is fixedly secured to the lower surface 312 of the top board 310. The outer surface 341 of the first lower board 340 is fixedly secured to the inner surface 322 of the first side board 320.

The upper surface 333 of the second side board 330 is fixedly secured to the lower surface 312 of the top board 310. The outer surface 351 of the second lower board 350 is fixedly secured to the inner surface 332 of the second side board 330.

The distance between the inner surface 322 of the first side board 320 and the inner surface 332 of the second side board 330 is substantially 5.3 inches. The distance between the lower surface 312 of the top board 310 and the upper surface 343 of the first lower board 340 is substantially 0.8 inches. The distance between the lower surface 312 of the top board 310 and the upper surface 353 of the second lower board 350 is substantially 0.8 inches. The distance between the inner surface 342 of the first lower board 340 and the inner surface 352 of the second lower board 350 is substantially 2.6 inches.

The base member slide assembly 300 is in sliding engagement with the base member 100 by partially enclosing the periphery thereof. As will be obvious, the intention is that base member slide assembly 300 move along the length of base member 100; accordingly, the dimensions of base member slide assembly 300 will be proportional to the dimensions of base member 100 such that minimal clearance exists between the two pieces; and that the clearance should be such that the pieces move easily while minimizing play between them.

With the foregoing in mind, the dimensions given herein for the respective pieces are not absolute. Rather, they may be changed so long as the spirit of the invention is achieved. Moreover, this principle applies to the dimensions of any of the pieces of the present invention, unless stated specifically otherwise, provided the apparatus is capable of connecting to a conventional compound miter saw and further capable of maintaining an angle relative to the blade of the miter saw such that wood may be cut at a desired angle and length.

The lock assembly 360 comprises a lock assembly connector 361 and a thumb screw 362. It is capable of fixing the position of the base member slide assembly 300 relative to the base member 100. The thumb screw 362 is in rotational engagement with the lock assembly connector 361. Base member slide assembly 300 is positioned as desired and the thumb screw 362 is tightened thereby securing the pieces with respect to each other.

One preferred embodiment (FIGS. 1-5) comprises lock assembly connector 361 being fixedly secured to the outer surface 321 of the first side board 320 approximate the center thereof. Lock assembly thumb screw 362 is threaded and is capable of being placed within lock assembly connector 361 which has a threaded recess to receive lock assembly thumb screw 362. A recess hole is displaced within first side board 320 so that lock assembly thumb screw 362 can move within the recess as it is rotated. Thus, base member slide assembly 300 can be locked in place relative to base member 100.

The primary purpose of the foregoing arrangement is to fix the position of the base member slide assembly 300 relative to the base member 100. It will therefore be obvious that lock assembly 360 can be fastened in the manner described above (with no loss in functionality) alternatively to first lower board 340, second lower board 350, second side board 330, or top board 310.

By way of example, one typical use of the invention comprises cutting a picture frame. A picture frame has four members, each of them having two ends each. Each end of each member must be cut at a 45 degree angle. In operation, saw interface 110 is connected to a conventional compound miter saw such that the cutting apparatus replaces the extension rail of the saw. First and second apertures 113, 114 of saw interface 110 are used for this purpose.

Base member 100 is partially enclosed by base member slide assembly 300 as it is positioned along the length of base member 100. Leg assembly 400 is used to ensure that base member 100 is substantially horizontal. The compound miter saw ("saw" herein) blade is then adjusted to the desired angle of 45 degrees. Guide 210 is set to the same angle of 45 degrees (90 degrees relative to the saw blade) and locked in place by angle lock 240. Thereafter, base member slide assembly 300 and brace assembly 200 (fixed relative to each other) may be moved along the length of base member 100 as multiple pieces of wood are cut at the exact angle. An end having an angled cut rests against guide 210 while the opposite uncut end of the member is cut by the saw at the same angle.

A first cut is made in one end of one of the frame members, independent of brace assembly 200. Then, the board is flipped upside down and the newly cut edge is placed against guide outer surface 211 so as to be parallel with it. Base member slide assembly 300 is then moved longitudinally along base member 100 so as to cause the board to be cut at the desired length. A second cut is made on the opposite end of the board. Thus, the first member of the picture frame is cut. This process is repeated to cut the opposite member of the picture frame except that base member slide assembly 300 is not moved. This insures that the second board is of identical length. A primary advantage of the present invention is thereby achieved because the second board is cut to the exact dimensions of the first board.

If the picture frame is square, the above procedure is repeated without moving any parts of the invention. Alternatively, if the picture frame is rectangular, base member slide assembly 300 must be repositioned before cutting the third and fourth picture frame members. Otherwise, the process is the same.

An alternative embodiment of the present invention comprises first and second measuring indicia (not shown) displaced on base member upper surface 103. The first measuring indicia is positioned substantially on the lateral center of the base member upper surface 103. The second measuring indicia is positioned substantially near an outer edge of base member upper surface 103. The first and second measuring indicia facilitate the placement of boards upon base member upper surface 103. As the boards to be cut are placed, measurements can be taken. Depending on the desired cut, the relevant edge of the board may be near the center or the outer edge. Having measuring indicia displaced near both areas facilitates measurement.

As will be appreciated, various means of displacing the measuring indicia on base member upper surface 103 may be used. For instance, tick marks at relevant intervals (e.g. 1, ½, ¼, ⅛, 1/16 inch) may be used without numerical designation. Alternatively, a numerical designation may accompany the marks. Additionally, only one set of measuring indicia may be used.

An alternate preferred embodiment (FIGS. 6-7) of an improved cutting apparatus comprises: base member 100A, saw interface 110A, guide 210A, machine screw 241A, upper washer 242A, lower washer 244A, wing nut 245A, leg assembly 400A, and slot 500A.

Base member 100A is elongated and rigid with rectangular cross section. It has first end 101A, second end 102A, upper surface 103A, lower surface 104A, face 105A of first end 101A, first side 106A, and second side 107A.

Base member 100A has a slot 500A that is displaced about the lateral center of base member 100A and extends substantially along the length thereof. The purpose of slot 500A is to allow guide 210A to move longitudinally along the length of base member 210A. Guide 210A can be locked in place by tightening wing nut 245A.

Saw interface 110A is substantially planar and has outer surface 11A, inner surface 112A, first aperture 113A, and second aperture 114A. Inner surface 112A of saw interface 110A is fixedly secured to the face 105A of the first end 101A of base member 100A.

Saw interface 110A is adapted to connect to a conventional compound miter saw such that the cutting apparatus replaces the extension rail of a conventional compound miter saw. Therefore, the purpose of saw interface 110A is similar to that of saw interface 110 depicted in FIGS. 1-5.

Leg assembly 400A has bottom cross member 410A, leg connector 420A, leg 430A, leg first end 431A, second end 432A of leg, and leg base 433A.

Leg 430A has adjustable length. Leg assembly 400A (not shown) is substantially similar to leg assembly 400 in the embodiment shown in FIG. 3. As will be appreciated, bottom cross member 410A should not coincide with slot 500. Otherwise the two embodiments are similar.

Bottom cross member 410A has an upper surface 411A, a lower surface 412A, and first end 413A. Bottom cross member 410A is elongated, rigid, and has rectangular cross-section. Upper surface 411A of bottom cross member 410A is fixedly secured to lower surface 104A of the base member 100A.

First end 413A of bottom cross member 410A is adjacent to second end 102A of base member 100A. It is located approximate the lateral center of the lower surface 104A of the base member 100A.

Figure 7:
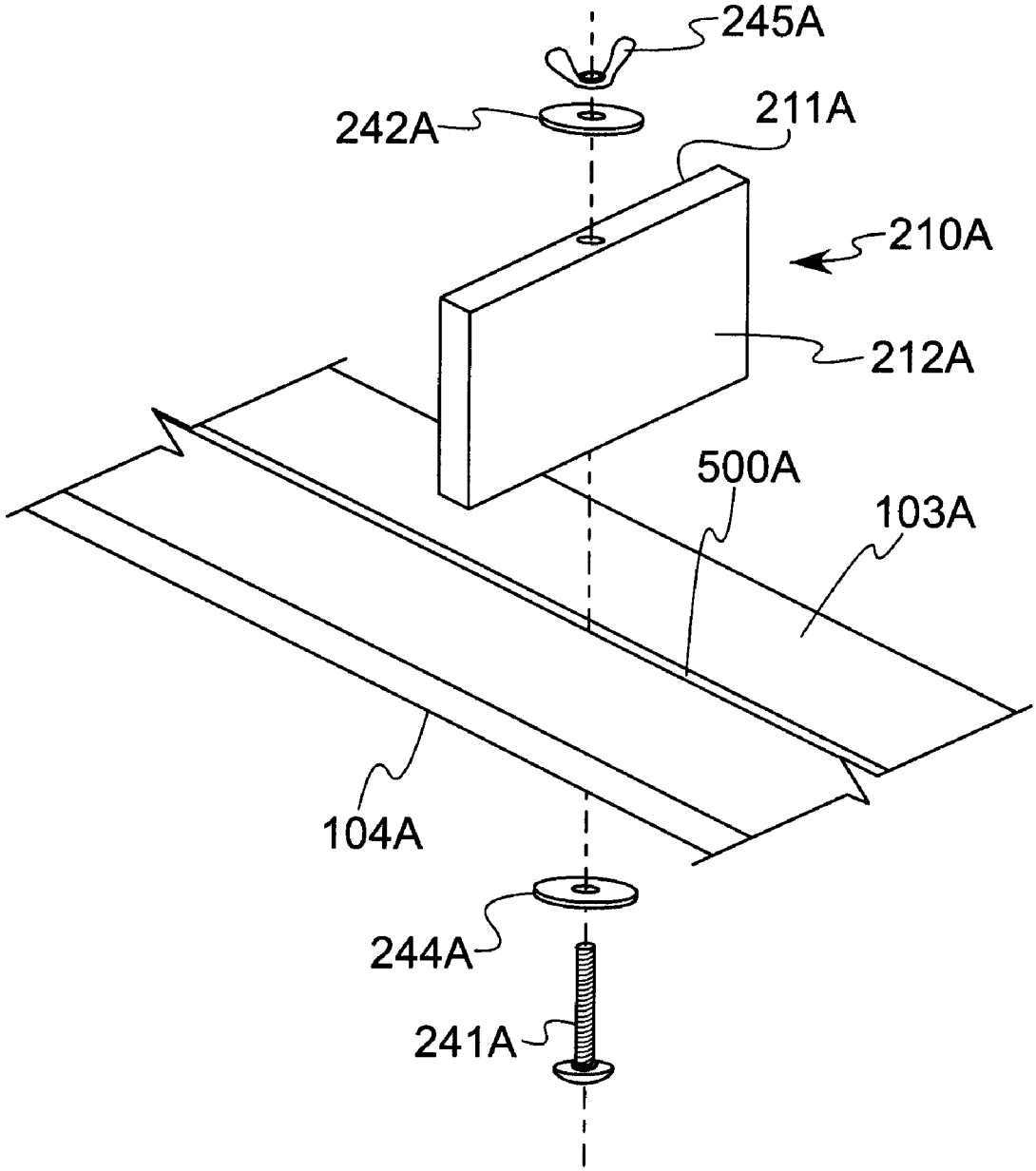
FIG. 7 depicts an exploded, fragmentary view of an alternate preferred embodiment of the present invention.

Guide 210A has outer surface 211A, and inner surface 212A. It has an aperture displaced vertically throughout. The aperture is displaced about the lateral center thereof and is substantially parallel to the outer and inner surfaces 211A, 212A of guide 210A. As depicted in FIG. 7, the location and placement of the aperture is apparent.

Machine screw 241A runs through lower washer 244A, slot 500A, guide 210A, upper washer 242A, and wing nut 245A. Lower washer 244A is located between the head of machine screw 241A and lower surface 104A of base member 100A. Upper washer 242A is located between guide 210A and wing nut 245A. Wing nut 245A is in rotational engagement with machine screw 241A.

Figure 6:
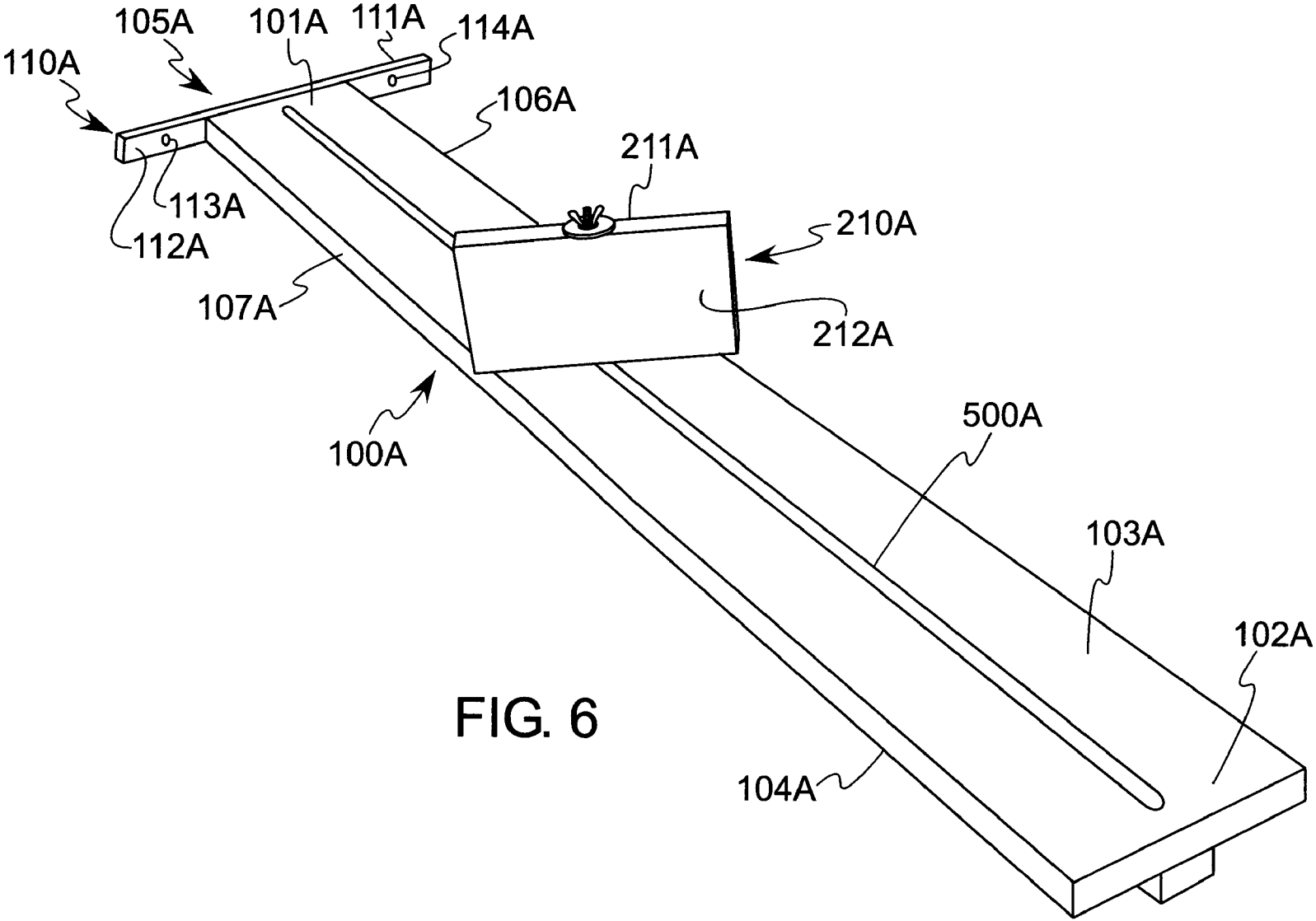
FIG. 6 depicts a perspective view of an alternate preferred embodiment of the present invention.

In operation, the alternate preferred embodiment depicted in FIGS. 6-7 is similar to the embodiment depicted in FIGS. 1-5. Guide 210A is manipulated to the desire angle and distance relative to the saw blade and board to be cut. This will be apparent to those of skill in the art.

As will be appreciated, the physical measurements of the various embodiments described throughout may be varied so long as the invention can replace the extension rail of an existing compound miter saw and so long as it is capable of cutting wood as described herein. Accordingly, it will be obvious that other dimensions can be used.

What is claimed is:

1. An improved cutting apparatus comprising:

a base member, said base member being elongated and rigid with rectangular cross section, said base member having a first end, a first side, a second side, a face of first end, a second end, a lower surface, and an upper surface;

a saw interface said saw interface being substantially planar, said saw interface having a first aperture, a second aperture, an inner surface, and an outer surface, said inner surface of said saw interface being fixedly secured to said face of said first end of said base member, said saw interface being adapted to connect to a conventional compound miter saw such that said cutting apparatus replaces the extension rail of a conventional compound miter saw;

a leg having adjustable length and being in communication with said lower surface of said base member;

a brace assembly comprising a guide, a guide support, a top cross member, and an angle lock, said guide having an outer surface and an inner surface, said guide support having a first side, an upper surface, and a lower surface, said first side of said guide support being fixedly secured to said inner surface of said guide, said guide support being located approximate the lateral center of said inner surface of said guide, said guide support having an aperture, said top cross member having an upper surface, a lower surface, and a first end, said top cross member having an aperture being approximate the center of said first end of said top cross member, said guide support being rotationally secured to said top cross member by said angle lock, said angle lock comprising a machine screw, an upper washer, a middle washer, a lower washer, and a wing nut, said machine screw running through said aperture of said top cross member, said lower washer, said middle washer, said aperture of said guide support, said upper washer, and said wing nut, said lower washer being located between the head of said machine screw and said lower surface of said top cross member, said middle washer being located between said upper surface of said top cross member and said lower surface of said guide support, said upper washer being located between said upper surface of said guide support and said wing nut, said wing nut in rotational engagement with said machine screw above said upper surface of said guide support, said aperture of said guide support being in the shape of an arc, so as to allow said guide to rotate about said base member;

a base member slide assembly comprising a top board, a first side board, a second side board, a first lower board, a second lower board, and a lock assembly, said top board having an upper surface, a lower surface, a first side, a second side, and a third side, said upper surface of said top board being fixedly secured to said lower surface of said top cross member, said top cross member being approximate the lateral center of said upper surface of said top board, said first side board having an outer surface, an inner surface, an upper surface, and a lower surface, said upper surface of said first side board being fixedly secured to said lower surface of said top board, said second side board having an outer surface, an inner surface, an upper surface, and a lower surface, said upper surface of said second side board being fixedly secured to said lower surface of said top board, said first lower board having an outer surface, an inner surface, an upper surface, and a lower surface, said outer surface of said first lower board being fixedly secured to said inner surface of said first side board, said second lower board having an outer surface, an inner surface, an upper surface, and a lower surface, said outer surface of said second lower board being fixedly secured to said inner surface of said second side board, said base member slide assembly being in sliding engagement with said base member by partially enclosing the periphery thereof, said lock assembly comprising a lock assembly connector, a thumb screw, and being capable of fixing the position of said base member slide assembly relative to said base member, said lock assembly connector being fixedly secured to said outer surface of said first board, said lock assembly connector being approximate the vertical center of said outer surface of said first side board, said thumb screw being in rotational engagement with said lock assembly connector;

whereby said base member being partially enclosed by said brace assembly;

further whereby said brace assembly being positioned along the length of said base member;

further whereby said leg being used to ensure said base member is substantially horizontal;

further whereby said guide of said brace assembly being adjusted to a desired angle relative to the saw blade of a compound miter saw;

further whereby a board being placed against said guide and said base member slide assembly being positioned to cut said board at a desired angle and length.

2. The apparatus of claim 1 further comprising:

said base member being substantially 5.25 inches in width by 47.9 inches in length by 0.8 inches in height;

said guide being substantially 6.9 inches in width by 3.8 inches in height;

said guide support being substantially 5.5 inches in length;

said top cross member being substantially 1.8 inches in width by 6 inches in length;

said top board being substantially 6.9 inches in width and 5.5 inches in length and 0.8 inches in height;

said first side board being substantially 4 inches by 2.1 inches;

said second side board being substantially 4 inches by 2.1 inches;

said first lower board being substantially 4 inches by 2.1 inches;

said second lower board being substantially 4 inches by 2.1 inches;

the distance between said inner surface of said first side board and said inner surface of said second side board being substantially 5.3 inches;

the distance between said lower surface of said top board and said upper surface of said first lower board being substantially 0.8 inches;

the distance between said lower surface of said top board and said upper surface of said second lower board being substantially 0.8 inches;

the distance between said inner surface of said first lower board and said inner surface of said second lower board being substantially 2.6 inches.

3. The apparatus of claim 1 further comprising:

first measuring indicia displaced on said base member upper surface.

4. The apparatus of claim 3 further comprising:

said first measuring indicia being positioned substantially on the lateral center of said base member upper surface;

second measuring indicia being positioned substantially near an outer edge of said base member upper surface;

further whereby said first and second measuring indicia may facilitate the placement of boards upon said base member upper surface.

5. An improved cutting apparatus comprising:

a base member, said base member being elongated and rigid with rectangular cross section, said base member being substantially 5.25 inches in width by 47.9 inches in length by 0.8 inches in height, said base member having a first end, a first side, a second side, a face of first end, a second end, a lower surface, and an upper surface;

a saw interface, said saw interface being substantially planar, said saw interface having a first aperture, a second aperture, an inner surface, and an outer surface, said inner surface of said saw interface being fixedly secured to said face of said first end of said base member, said saw interface being adapted to connect to a conventional compound miter saw such that said cutting apparatus replaces the extension rail of a conventional compound miter saw;

a leg assembly comprising a bottom cross member, a leg, a leg connector, and a leg base, said bottom cross member having an upper surface, a lower surface, and a first end, said bottom cross member being elongated, rigid, and having rectangular cross-section, said upper surface of said bottom cross member being fixedly secured to said lower surface of said base member, said first end of said bottom cross member being adjacent to said second end of said base member, said bottom cross member being located approximate the lateral center of said lower surface of said base member, said leg having a first end and a second end, said leg connector being fixedly secured to said lower surface of said bottom cross member, said leg connector being located approximate the lateral center of said lower surface of said bottom cross member, said leg having a circular cross-section, said leg having a threaded outer surface and being in threaded communication with said leg connector, said second end of said leg being rotatedly secured to said leg base;

a brace assembly comprising a guide, a guide support, a top cross member, and an angle lock, said guide being substantially 6.9 inches by 3.8 inches, said guide having an outer surface and an inner surface, said guide support having a first side, an upper surface, and a lower surface, said guide support being substantially 5.5 inches in length, said first side of said guide support being fixedly secured to said inner surface of said guide, said guide support being located approximate the lateral center of said inner surface of said guide, said guide support having an aperture, said top cross member having an upper surface, a lower surface, and a first end, said top cross member being substantially 1.8 inches in width by 6 inches in length, said top cross member having an aperture being approximate the center of said first end of said top cross member, said guide support being rotationally secured to said top cross member by said angle lock, said angle lock comprising a machine screw, an upper washer, a middle washer, a lower washer, and a wing nut, said machine screw running through said aperture of said top cross member, said lower washer, said middle washer, said aperture of said guide support, said upper washer, and said wing nut, said lower washer being located between the head of said machine screw and said lower surface of said top cross member, said middle washer being located between said upper surface of said top cross member and said lower surface of said guide support, said upper washer being located between said upper surface of said guide support and said wing nut, said wing nut in rotational engagement with said machine screw above said upper surface of said guide support, said aperture of said guide support being in the shape of an arc, so as to allow said guide to rotate about said base member;

a base member slide assembly comprising a top board, a first side board, a second side board, a first lower board, a second lower board, and a lock assembly, said top board being substantially 6.9 inches in width and 5.5 inches in length and 0.8 inches in height, and having an upper surface, a lower surface, a first side, a second side, and a third side, said first side board being substantially 4 inches by 2.1 inches and having an outer surface, an inner surface, an upper surface, and a lower surface, said second side board being substantially 4 inches by 2.1 inches and having an outer surface, an inner surface, an upper surface, and a lower surface, said first lower board being substantially 4 inches by 2.1 inches and having an outer surface, an inner surface, an upper surface, and a lower surface, said second lower board being substantially 4 inches by 2.1 inches and having an outer surface, an inner surface, an upper surface, and a lower surface, said upper surface of said top board being fixedly secured to said lower surface of said top cross member, said top cross member being approximate the lateral center of said upper surface of said top board, said upper surface of said first side board being fixedly secured to said lower surface of said top board, said upper surface of said second side board being fixedly secured to said lower surface of said top board, said outer surface of said first lower board being fixedly secured to said inner surface of said first side board, said outer surface of said second lower board being fixedly secured to said inner surface of said second side board, the distance between said inner surface of said first side board and said inner surface of said second side board being substantially 5.3 inches, the distance between said lower surface of said top board and said upper surface of said first lower board being substantially 0.8 inches, the distance between said lower surface of said top board and said upper surface of said second lower board being substantially 0.8 inches, the distance between said inner surface of said first lower board and said inner surface of said second lower board being substantially 2.6 inches, said base member slide assembly being in sliding engagement with said base member by partially enclosing the periphery thereof, said lock assembly comprising a lock assembly connector, a thumb screw, and being capable of fixing the position of said base member slide assembly relative to said base member, said lock assembly connector being fixedly secured to said outer surface of said first board, said lock assembly connector being approximate the vertical center of said outer surface of said first side board, said thumb screw being in rotational engagement with said lock assembly connector;

whereby said base member being partially enclosed by said brace assembly;

further whereby said brace assembly being positioned along the length of said base member;

further whereby said leg assembly being used to ensure said base member is substantially horizontal;

further whereby said guide of said brace assembly being adjusted to a desired angle relative to the saw blade of a compound miter saw;

further whereby a board being placed against said guide and said base member slide assembly being positioned to cut said board at a desired angle and length.

6. The apparatus of claim 5 further comprising:

first and second measuring indicia displaced on said base member upper surface;

said first measuring indicia being positioned substantially on the lateral center of said base member upper surface;

said second measuring indicia being positioned substantially near an outer edge of said base member upper surface;

further whereby said first and second measuring indicia may facilitate the placement of boards upon said base member upper surface.

* * * * *